United States Patent [19]

Ross

[11] 4,180,006

[45] Dec. 25, 1979

[54] TENSION SELECTING MECHANISM FOR SEWING MACHINES

[75] Inventor: Roger J. Ross, Mont St-Gregoire, Canada

[73] Assignee: The Singer Company, New York, N.Y.

[21] Appl. No.: 892,066

[22] Filed: Mar. 31, 1978

[51] Int. Cl.[2] ..... D05B 47/02

[52] U.S. Cl. ..... 112/254

[58] Field of Search ..... 112/254, 255, 59, 97; 242/150 R

[56] References Cited

U.S. PATENT DOCUMENTS

| | | | |
|---|---|---|---|
| 119,589 | 10/1871 | Estabrooke | 112/254 |
| 473,564 | 4/1892 | Allen | 112/255 X |
| 2,609,772 | 9/1952 | Casas-Robert | 112/254 |
| 3,081,722 | 3/1963 | Peloggio | 112/255 X |
| 3,557,731 | 1/1971 | Casas-Robert | 112/254 |
| 3,667,414 | 6/1972 | Illes et al. | 112/254 |
| 4,141,306 | 2/1979 | Weber | 112/254 |

FOREIGN PATENT DOCUMENTS

| | | | |
|---|---|---|---|
| 616006 | 1/1961 | Italy | 112/254 |

*Primary Examiner*—Wm. Carter Reynolds
*Attorney, Agent, or Firm*—Robert E. Smith; Michael H. Wallach; Edward L. Bell

[57] ABSTRACT

A mechanism for selecting the tension setting of a needle thread tension device for sewing machines. A slot is formed in the face of the sewing machine arm top cover through which extends an operator influenced tension selecting knob. The tension device for influencing the needle thread tension is connected to the tension selecting knob by a leaf spring and lever fulcrummed to the arm top cover. Movement of the tension selecting knob along the slot in the arm top cover varies the force exerted on the needle thread by the tension discs contained within the tension device.

1 Claim, 3 Drawing Figures

TENSION SELECTING MECHANISM FOR SEWING MACHINES

BACKGROUND OF THE INVENTION

1. Field of the Invention

This invention relates to sewing machines in general and more paricularly to sewing machines having needle thread tension adjusting devices.

2. Description of the Prior Art

Needle thread tension adjusting devices are well known in the prior art. See for example U.S. Pat. No. 2,955,775 to Johnson; U.S. Pat. No. 2,965,058 to Herbst et al; U.S. Pat. No. 3,667,414 to Illes et al; and U.S. Pat. No. 3,785,309 to Ketterer. Each of the cited patents discloses a needle thread tension adjusting device which employs a form of circular dial for setting the tension thereof. One problem associated with prior known needle thread tension adjusting devices is the number of components required to assemble the device. Another problem is the difficulty encountered in initially adjusting the devices when they are assembled so that the same tension setting on successive devices produces the identical needle thread tension.

SUMMARY OF THE INVENTION

An object of this invention is to produce a tension selecting mechanism for adjusting the tension imparted to a needle thread by a thread tension device which utilizes a minimum number of parts.

Another object of this invention is to produce a tension selecting mechanism which is easily adjusted at the time of the assembly of the components.

Still another object of this invention is to provide a tension selecting mechanism which is easily adjusted by a sewing machine operator.

The disclosed objects and other advantages of this invention are obtained by a slidably adjustable leaf spring biasing a fulcrummed lever which controls the force imparted to the needle thread tension discs through an axially shiftable rod. The sewing machine arm top cover contains a slot which is perpendicular to the fulcrum of the lever and through which passes an extension of a leaf spring. An operator influenced tension selecting knob is attached to the extension of the leaf spring for slidable adjustment of the leaf spring along the length of the fulcrummed lever. The other end of the leaf spring is bent to form a contact point. The fulcrummed lever is pivotally mounted at a fulcrum point to connect the leaf spring with an axially shiftable rod. The leaf spring contact point may be shifted along the length of the fulcrummed lever by operator movement of the tension selecting knob along the slot contained in the arm top cover. The movement of the knob results in a change in the force imparted to the axially shiftable tension disc adjusting rod. The thread tension device contains a plurality of tension discs which impart a drag to the needle thread passing therethrough in a well known manner. The force imparted to the thread by the tension discs is controlled by the tension placed on the axially shiftable rod by the fulcrummed lever. The force applied to the fulcrummed lever may be varied by slidably changing the point of contact of the leaf spring against the fulcrummed lever.

BRIEF DESCRIPTION OF THE DRAWINGS

The above and other objects of this invention will be evident from an understanding of the preferred embodiment which is hereinafter set forth in such detail as to enable those skilled in the art to readily understand the function, operation, construction, and advantages of it when read in conjunction with the accompanying drawings in which.

DESCRIPTION OF THE PREFERRED EMBODIMENT

Figure 1:
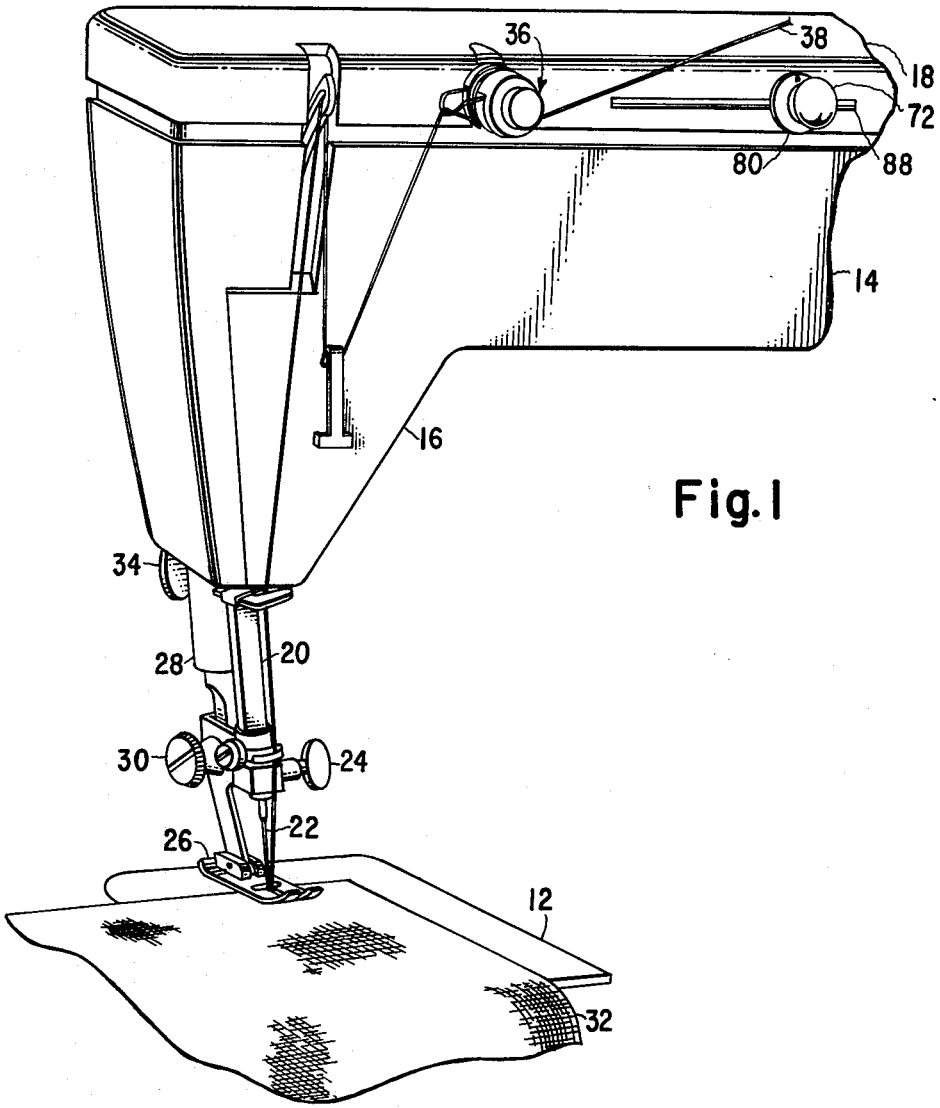
FIG. 1 is a perspective view of a portion of a sewing machine having a tension selecting mechanism constructed in accordance with the principles of this invention.

Referring to FIG. 1 of the drawings, this invention is shown applied to a sewing machine having a bed 12 and a bracket arm 14 overhanging the bed and terminating in a sewing head 16. The bracket arm 14 and sewing head 16 are preferably hollow and are provided with a top cover plate 18 designed to enclose the open bracket arm 14. Journalled in the sewing head 16 is a reciprocating needle bar 20. The needle bar 20 has a needle 22 removably attached thereto by a needle clamp device 24. A presser foot 26 is removably attached to a presser bar 28 by a presser clamp screw 30. The presser foot 26 clamps a work piece 32 against the bed 12 in timed relation to the reciprocation of the needle bar 20. A presser lifter lever 34 is pivoted on the sewing head 16 for manually raising and lowering the presser foot 26. Journalled in the arm top cover 18 is a needle thread tension device 36 of a well known design for influencing the drag imparted to a needle thread 38.

Figure 2:
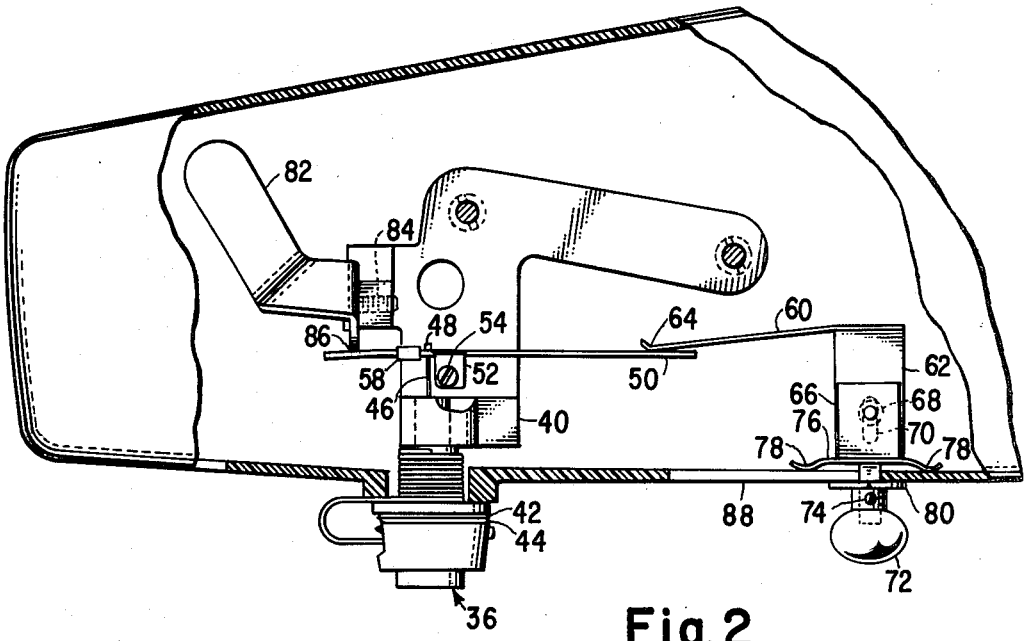
FIG. 2 is an overhead cutaway view of a portion of the arm of a sewing machine showing the mechanism of this invention.

As illustrated in FIG. 2, the needle thread tension device 36 is journalled to the arm top cover 18 by a mounting bracket 40. The needle thread tension device may be adjustably influenced by the sewing machine operator to control the amount of drag imparted to a needle thread 38 passing therethrough. FIG. 2 also shows two tension discs 42 and 44 which are preferably mounted coaxially on a supporting stud (not shown) and which influence the tension of the needle thread 38 disposed between them in a well known manner. An axially shiftable rod 46 having a head 48 controls the tension imparted by tension discs 42 and 44 to the needle thread by the axial displacement thereof.

A lever 50 having an axis along its length has a pair of laterally extending pivot tabs 52 formed at a pivot point thereof. The lever 50 is pivotally journalled to the mounting bracket 40 by a pivot pin 54 which passes through an aperture in the pivot tabs 52 and is threadedly journalled to the mounting bracket 40. The pivot tabs form a fulcrum point about which the lever 50 may be pivoted. One end of the lever 50 contains a slot 56 having an aperture formed at one end thereof for receiving the head 48 of the axially shiftable rod 46. A spring clip 58 is adapted to embrace the lever 50 and cover the aperture in the slot 56 after the assembly of the rod to the lever, thereby restraining the head of the rod from passing through the aperture. The width of the aperture is larger than the diameter of the axially shiftable rod 46 and smaller than the diameter of the head 48 of the axially shiftable rod such that arcuate pivotal motion of the lever 50 about the pivot pin 54 will cause the axially shiftable rod 46 to be shifted outwardly from the needle thread tension device 36. The drag imparted to the needle thread 38 by the tension discs 42 and 44 of the needle thread tension device 36 is proportional to the force imparted outwardly against the head 48 of the axially shiftable rod 46 by the lever 50. A more detailed explaination of the operation of a needle thread tension device whose tension may be adjusted by the device of this invention may be had by reference to U.S. Pat. No. 3,667,414, which is owned by the assignee of this invention.

FIG. 2 also shows the leaf spring 60 having an extension 62 preferably formed at a right angle thereto. The other end of the leaf spring 60 has a leaf spring contact point 64 bent therein and adapted for exerting a spring bias against the lever 50. The leaf spring extension 62 has fastened thereto an operator accessible clamp means for influencing the location of contact of the point 64 along the length of the lever 50 between a free end thereof and the fulcrum. The leaf spring extension 62 has attached thereto a tension knob carrier stud 66 by a conventional fastener means such as a rivet 68 passing through an adjusting slot 70, the tension knob carrier stud 66 being substantially perpendicular to the axis of the lever 50. A tension selecting knob 72 is adjustably fastened to an extension of the tension knob carrier stud 66 by a conventional fastener means such as a set screw 74. A spring clip 76 having contact points 78 formed at both of its ends is disposed between the wall of the arm top cover 18 and the tension knob carrier stud 66. The tension selecting knob 72 is formed with a circular knob retainer surface 80 adapted to slidably restrain the tension selecting knob 72 against the outside surface of the arm top cover 18. The pressure of the spring clip contact points 78 against the inside wall of the arm top cover 18 forces the knob retainer surface 80 to be slidably urged against the outside wall of the arm top cover 18.

Figure 3:
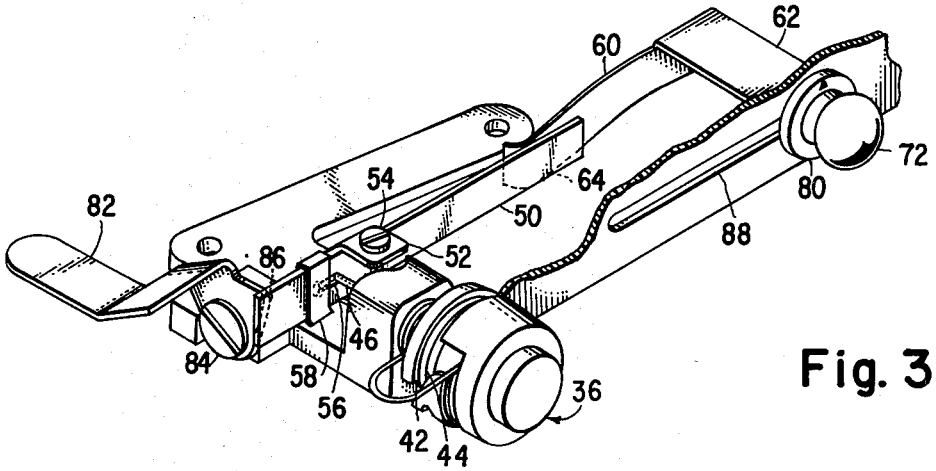
FIG. 3 is a perspective view showing the mechanism of this invention connected to influence the setting of a needle thread tension device.

As illustrated in FIG. 3, an offset lever arm 82 is pivotally journalled to the mounting bracket 40 by a conventional fastener means such as a screw 84. The offset lever arm has a cam lobe 86 disposed at one end thereof, for influencing the arcuate pivotal motion of the lever 50. The offset lever arm 82 is influenced by the presser lifter lever 34 so that when the presser foot 26 is movably lifted from the work piece 32 by operation of the presser lifter lever 34, the cam lobe 86 arcuately rotates against the lever 50 causing the lever 50 to arcuately pivot about the pivot pin 54, thereby relieving tension from the axially shiftable rod 46. The needle thread 38 may thereafter be conveniently drawn through the needle thread tension device due to the release of tension on the tension discs 42 and 44 by the release of tension from the axially shiftable rod 46.

The leaf spring 60 is preferably formed with an inward sloping shape so that it exerts a positive pressure which is directed toward the front inside surface of the arm top cover 18 at the point where the leaf spring contact point 64 contacts the lever 50. The pressure applied to the lever 50 by the leaf spring 60 results in the lever 50 exerting a tension on the axially shiftable rod 46 as a result of the pivot pin 54 being disposed on the lever between the point of contact of the leaf spring contact point 64 and the connection point of the axially shiftable rod 46 to the lever. The amount of tension exerted by the lever 50 against the axially shiftable rod 46 is dependent on the distance along the lever 50 between the point at which the leaf spring contact point 64 contacts the lever and the pivot pin 54. The tension exerted by the axially shiftable rod 46 against the tension discs 42 and 44 may be varied by changing the distance between the pivot pin 54 and the leaf spring contact point 64. Increasing the distance will increase the tension applied to the axially shiftable rod 46 and decreasing the distance will decrease the tension applied to the axially shiftable rod 46. The location at which the leaf spring contact point 64 engages the lever 50 is varied by slidably translating the tension selecting knob 72 along the length of a slot 88 which is formed perpendicular to the pivot pin 54 in the arm top cover. It will thereby be apparent from a complete understanding of the foregoing discussion that by moving the tension adjusting knob 72 away from the needle thread tension device 36 the tension imparted to the needle thread 38 will be increased and by moving the tension adjusting knob 72 toward the thread tension device 36 the tension imparted to the needle thread 38 will be decreased.

It should thus be clear that a simple and reliable tension selecting mechanism using a minimum number of parts has been discribed in this application. Numerous alterations of the structure herein disclosed will be apparent to those skilled in the art. However, it is to be understood that the present disclosure relates to a preferred embodiment of the invention which is for purposes of illustration only and not to be construed as a limitation of the scope of the invention. All such modifications which do not depart from the spirit of the invention are intended to be included within the scope of the appended claims.

Having thus set forth the nature of the invention, what is claimed herein is:

1. An improved tension selecting mechanism for a sewing machine having a frame including a work supporting bed and a hollow upwardly open bracket arm overhanging said bed, an arm top cover to enclose said open bracket arm having a horizontal slot formed therein, an endwise reciprocating thread-carrying needle, a needle thread tension device including a first thread engaging disc and a second thread engaging disc carried on a supporting stud for applying frictional resistance to the movement of a needle thread between said first and said second discs, an axially shiftable rod for moving said first thread engaging disc toward and away from said second thread engaging disc, a lever having a supporting fulcrum and a free end, means on said lever spaced from said fulcrum for engaging said axially shiftable rod, leaf spring supported relatively to said sewing machine frame and having a contact point formed at one end thereof to impart a spring bias to a location along said lever between said free end and said fulcrum to apply a tension to said axially shiftable rod, wherein the improvement comprises an operator influenced clamp means for adjusting the point of contact between said lever and said leaf spring, said clamp means including a stud projecting from said leaf spring through said slot in said arm top cover, said stud being substantially perpendicular to the axis of said lever, means associated with said stud for frictionally resisting movement thereof along said slot, and a selecting knob on said stud slidably carried exteriorly of said arm top cover for slidably varying the point of contact between said lever and said leaf spring.

* * * * *